United States Patent [19]

Noguchi et al.

[11] Patent Number: 4,984,957

[45] Date of Patent: Jan. 15, 1991

[54] WORK-IMPLEMENT ADAPTER FOR FRONT LOADER

[75] Inventors: Michio Noguchi; Kazushige Mori; Nobuo Higashino; Motoki Sunada, all of Sakai, Japan

[73] Assignee: Kubota, Ltd., Osaka, Japan

[21] Appl. No.: 369,593

[22] Filed: Jun. 21, 1989

[30] Foreign Application Priority Data

| | | | |
|---|---|---|---|
| Aug. 8, 1988 | [JP] | Japan | 63-197785 |
| Aug. 10, 1988 | [JP] | Japan | 63-105596[U] |
| Sep. 16, 1988 | [JP] | Japan | 63-233133 |
| Sep. 16, 1988 | [JP] | Japan | 63-121875[U] |

[51] Int. Cl.[5] ..... E02F 3/34

[52] U.S. Cl. ..... 414/723; 172/430; 172/273; 172/751; 172/753

[58] Field of Search ..... 414/723; 172/430, 272, 172/273, 749, 751, 753

[56] References Cited

U.S. PATENT DOCUMENTS

| | | | |
|---|---|---|---|
| Re. 19,846 | 2/1936 | Ronning et al. | 172/340 X |
| 3,011,275 | 12/1961 | White, Jr. | 172/430 X |
| 3,760,883 | 9/1973 | Birk | 414/723 X |
| 4,253,793 | 3/1981 | Braml | 414/723 |

FOREIGN PATENT DOCUMENTS

| | | | |
|---|---|---|---|
| 0136734 | 4/1985 | European Pat. Off. | 172/430 |
| 63-9350 | 8/1988 | Japan . | |
| 63-130551 | 8/1988 | Japan . | |
| 63-185847 | 11/1988 | Japan . | |

*Primary Examiner*—Robert J. Spar
*Assistant Examiner*—Donald W. Underwood
*Attorney, Agent, or Firm*—Edwin E. Greigg

[57] ABSTRACT

An adapter for operatively connecting a work implement such as a bucket or fork to a loader vehicle body. The adapter may be commonly used for connection of various types or sizes of implements. Though easy to use and manufacture, the adapter provides strong, reliable and balanced connection between the vehicle and implement through its pair of side brackets and one center bracket which are rigidly connected with each other via a common support frame and which pivotably connect in substantially straight alignment respectively with a pair of implement lift arms and one implement pivot arm extending from the vehicle body.

14 Claims, 13 Drawing Sheets

WORK-IMPLEMENT ADAPTER FOR FRONT LOADER

BACKGROUND OF THE INVENTION

1. Field of the Invention

The present invention relates to a work-implement connecting adapter for a front loader for readily and detachably attaching a front-mount work implement such as buckets or forks of various capacities depending on the necessity, and more particularly to a connecting adapter of the above-noted type connecting at a front portion thereof the front-mount work implement and connecting at rear portions thereof a pair of right and left work-implement lifting arms extending from the vehicle body and a work-implement pivot arm disposed at a middle therebetween.

2. Description of the Prior Art

A connecting adapter of the above-noted type is known, for example, from a Japanese utility model laid open under Showa 63-9350. This adapter is used for connecting a bucket as an example of a front-mount work implement and a loader vehicle body. More particularly, the bucket projectedly attaches on its back face an engaging member for engagement with a tapered engaging portion of the adapter which is inserted into the backet from under. The bucket further includes at opposed ends thereof a pair of right and left bracket members for engagement with lower portions of opposed outer peripheral edges of the adapter. On the other hand, the loader vehicle body mounts a pair of work-implement lift arms and a work-implement pivot arm disposed therebetween, for the engagement with the adapter. Refering more particularly to the adapter construction, there is provided a plate type frame formed with a curve so as to follow the back face of the bucket, the plate frame extending between the entire width between the right and left pair of brackets of the front-mount work implement. The plate frame forms at its upper end thereof a tapered engaging portion to be engaged from under with the engaging member projecting from the bucket back face. Further, the plate frame carries a plurality of connecting plate members extending vertically and rearwardly from the plate frame and for engagement with the pair of work-implement lift arms and the work-implement pivot arm, with the plate members acting also for reinforcement. Also, the front end of each plate member is formed so as to follow the back face of the bucket as is the case with the plate type frame.

Then, if the work implement and the vehicle body are to be connected through the above-described construction, the connecting construction differs between the case where the adapter is used and the case where the adpter is not used (i.e. for using the adapter, there must be provided at least a stopper element on the back face of the work implement). Accordingly, in order to cope with these cases, two different types of work implements are needed. Moreover, it is needless to say that this adapter cannot be commonly used for the different types of work implements. Further, in this adapter, since the plate type frame curved to follow the back face of the work implement is caused to extend over the entire width of the work implement, such special formation of the frame per ser is troublesome and difficult, and if there occurs a deformation in the same through its use, the connecting operation cannot be carried out smoothly. Also, the adapter per se is physically large and rather heavy in weight.

In view of the above-described state of the art, the primary object of the present invention is to provide an improved work-implement connecting adapter which can overcome the above-described various drawbacks of the prior device. That is, according to the improved adapter of the invention, when the same type of work implement, e.g. bucket is used, there is no need for modifying the connecting construction of the implement whether the adapter is used or not used for the connection. Further, the adapter may be commonly used for different types of work implement such as a bucket or a fork and so on. Moreover, the improved adapter is advantageous in that the construction is simple and light weight and the adapter can be used easily and efficiently for connecting operation.

SUMMARY OF THE INVENTION

In order to accomplish the above-described object, according to the present invention, the adapter comprises: a pair of right and left side brackets, each bracket including a pair of plate members rigidly interconnected via a vertical plate frame extending laterally relative to the vehicle body, the side brackets pivotably connecting the pair of work-implement lift arms and a pair of lifting connected members fixed to the work implement; a support frame for fixedly connecting between the inner pair of the plate members of the side brackets; and a center connecting bracket disposed at an intermediate portion of the support frame and having at a front portion thereof an engaging hook portion for pivotably connecting a pivoting connected member of the work implement and pivotably connecting the work-implement pivot arm at a rear portion thereof.

With the adapter having the above-described construction, the pair of right and left work-implement lift arms and the work-implement pivot arm extending from the vehicle body come into connection, from the rear side of the adapter body, with the pair of right and left side brackets and the center bracket, respectively. Whereas, at the front side of the adapter body, the lifting connected members and the pivoting connected member of the work implement are pivotably connected with the side brackets and the center bracket, respectively. That is to say, the work-implement lift arms from the vehicle body and the connecting portions of the work implement are connected via the side brackets with substantially straight alignement with respect to the transverse direction of the vehicle body. Further, the center connecting bracket disposed at the middle portion of the support frame pivotably connects at its engaging hook portion at a front side thereof the pivoting connected member of the work implement and pivotably connects at the rear side thereof the work-implement pivot arm. That is to say, with the disclosed construction, the connection between the adapter and the work implement is provided only through the above three portions which are aligned substantially straight with respect to the transverse direction of the vehicle body. For actually carrying out the above connecting operations, the vehicle body is advanced towards the work implement while maintaining the adapter in such a way as to position the center bracket forwardly of the side brackets until the engaging hook portion of the adapter comes into hooked engagement with the pivoting connected member of the implement. Then, after slightly adjusting, i.e. errecting the posture of the adapter for securing the hooked engagement, the pivot arm is operated rearwardly for further erecting the adapter until the pair of side brackets of the adapter come into overlapped engagement with the pair of lifting connected members of the implement respectively, whereby the side brackets of the adapter and the connected members of the implement are pivotably connected with each other.

With the above construction, the members such as the work-implement lift arms and the work-implement pivot arm required for connections in the above construction maintain substantially the same positional relationships relative to the transverse direction of the vehicle body. Moreover, the connecting constructions of the vehicle body—adapter, and the adapter—work implement are provided by the very simple pivotal connections using the pins or the like. Then, with the present invention, the connecting mechanism may remain unaffected by e.g. the varied configurations of the work implements and requires minimum components required for the pivotal connections. Accordingly, unlike the prior art, the connecting construction may remain the same regardless of the type of the front-mount work implement, and also the construction may remain the same also whether the adapter is used or not for connecting the work implement. Further, on the side of the work implement, the connection is effected through the simple arrangement including only the pivoting connected member provided at the central position and the lifting connected members. Accordingly, this adapter may be commonly used for connecting various types of work implement such as a fork or a bucket.

As for the construction strength, since the work-implement lift arms and the work-implement pivot arm are connected via the adapter with the lifting connected members and the pivot connected member of the implement in substantially straight alignment in the longitudinal direction of the vehicle body, there hardly occurs loss or imbalance in the power transmission between the vehicle and the implement or distortion of the construction. Also, since the construction is formed as a three-point connecting structure with the lift members being its center, the construction is superior in balance as well. And, because of absence of a large plate type member, the adapter is highly resistent against deformation yet is light in weight. Moreover, since the right and left pair of side brackets are rigidly interconnected via their inner pair of side plates through the common support frame, with the side plates of each side bracket being rigidly connected through the vertical plate type frame. With these features, the construction of the entire adapter is superior in strength.

According to one preferred embodiment of the invention, the adapter further comprises:

a link mechanism for pivotably and detachably connecting the front-mount work implement by means of a right and left pair of connecting pins, with one connecting pin being pivotably connected to one pivotal end of a pivot arm pivotably supported to the support frame whereas the other connecting pin being pivotably connected to the other pivotal end of the pivot arm via a link, wherein a pivotably connected condition is realized if the connecting pins slide simultaneously towards the outside to come into engagement with the work implement while alternately and selectively a connection-released condition is realized if the connecting pins slide simultaneously towards the inside to come out of the engagement.

With the above features, a connecting or disconnecting operation between the vehicle and the work implement may be conveniently and selectively effected through an operation of the pivot arm which causes the connecting pins to simultaneously slide towards either the outside or the inside.

According to a further embodiment of the invention, the adapter further comprising:

a pivot lock arm for locking the pivot arm at the engaged position and for releasing the same therefrom, the locked condition being realized as a first stepped portion of the pivot arm comes into engagement with a lock engaging portion of the pivot lock arm, and the pivot arm further including a second stepped portion which comes into abutment with the lock engaging portion thereby limiting movement of the pivot arm towards the releasing side exceeding the released position thereof.

With the above features, the regulations of the two positions, i.e. the connected condition and the released condition of the pivot arm, i.e. the connecting pins are effected through the engagements of only two members, i.e. the pivot arm and the lock arm. Accordingly, the precision in the regulations of the respective positions may be improved. Further, a switching operation from the released condition to the connected condition may be effected very conveniently by operating the pivot arm by means of e.g. an operational lever, with no special releasing operation being needed. Consequently, the operation may be significantly facilitated and the operational safety may be also improved since the pivot type lock arm provides a reliably locking effect at the connected condition.

According to a still further embodiment of the invention, respective pivot connecting portions for the lift arms, the pivot arm and the respective connecting brackets are recessed forwardly relative to the rear end of the support frame 15 the side view, and pivot connecting portions for the right and left connected members of the work implement and the respective connecting brackets are recessed rearwardly relative to the front end of the support frame.

With the above features, the connections between the lift arms and the work implement are positioned at the sides of the reinforcing support frame. Also, each side connecting bracket is formed of the pair of plate members rigidly interconnected via the vertical plate frame. Accordingly, only the plate frame member exists in the fore-and-aft middle portion between the pivotal connecting portions with the lift arms and the pivotal connecting portions with the work implement, whereby it becomes possible to reduce the fore-and-aft interdistances between the respective connections. In the case of the center connecting bracket, its forward and rearward pivot connection portions may be disposed close to each other as there exist no elements therebetween. Then, similarly to the side connecting brackets, if the connecting portions are recessed from the front and rear ends of the support frame respectively, the fore-and-aft distance may be reduced. Consequently, the driving and operating feels of the front-mount work implement do not significantly change from those of the case of direct connection, and the operational efficiency has been improved.

BRIEF DESCRIPTION OF THE DRAWINGS

Accompanying drawings illustrate preferred embodiments of a connecting adapter for a front-mount work implement related to the present invention; in which.

DESCRIPTIONS OF THE PREFERRED EMBODIMENTS

Preferred embodiments of the present invention will be particularly described hereinafter with reference to the accompanying drawings.

Figure 1:
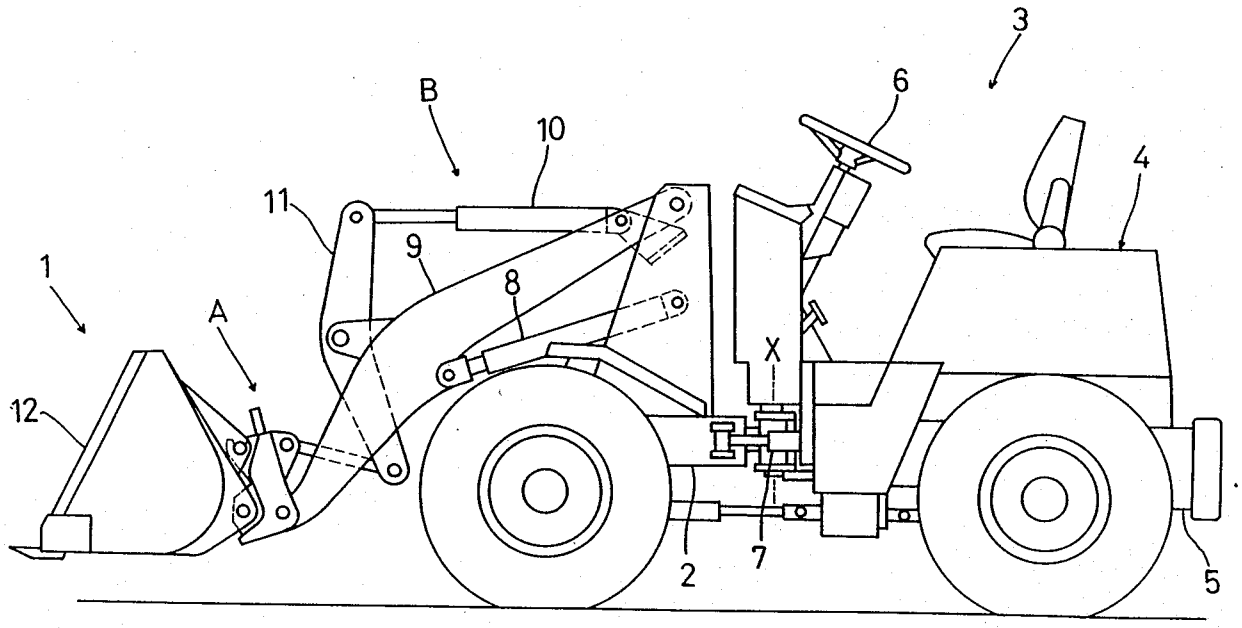
FIG. 1 is an overall side view of a front-loader equipped work vehicle.

FIG. 1 shows a work vehicle equipped with a workimplement connecting adapter A related to the present invention. This work vehicle includes a front body 2 having a front loader implement 1 and a rear body 5 having a driver's cabin 3, an engine and so on. The front body and the rear body are interconnected as being pivotably relative to each other about a vertical axis X by an extension or contraction of a hydraulic cylinder 7 operated by a steering wheel 6.

The front loader 1 includes a pair of right and left work-implement lift arms 9, 9 extending forwardly from the front body 2 and lifted up and down by a hydraulic cylinder 8, a work-implement pivot arm 11 disposed at the middle between the right and left arms and pivotable about a horizontal axis by means of a hydraulic cylinder 10, with the arms 9, 9 and the arm 11 being connected to a rear portion of the adapter A, and a digging bucket 12 detachably attached to a front portion of the adapter A. The bucket 12 may be directly connected to the respective arms 9, 9 and 11 without the adapter A.

Figure 2:
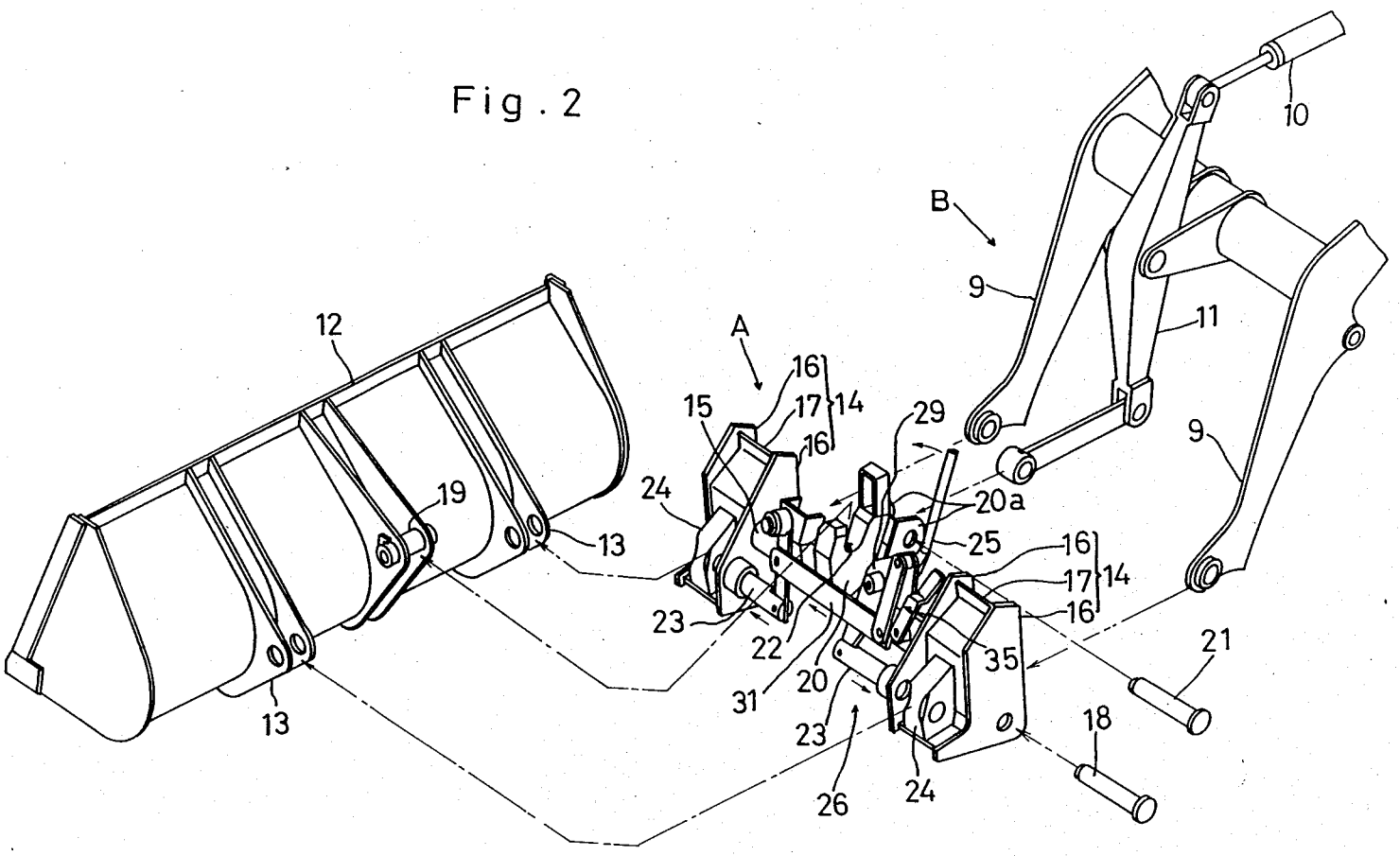
FIG. 2 is an exploded perspective view of major portions of the adapter.

Next, refering to FIG. 2, the adapter A includes a pair of right and left side connecting brackets 14 and 14 for pivotably connecting the lift arms 9, 9 and a pair of lifting connected members 13, 13 fixed to the bucket 12, with the brackets 14, 14 being fixedly interconnected via a round pipe type support frame 15. Each side connecting bracket 14, 14 includes a pair of right and left plate members 16, 16 aligned in the fore and aft direction and fixedly interconnected via a laterally extending vertical plate frame 17, and the inner plate members 16, 16 of the brackets are rigidly connected to each other via the support frame 15. At a rear side of the vertical plate frame 17, the lift arm 9 is inserted and pivotably connected at a position between the plate members 16, 16 by means of a pin 18.

Further, at the middle point of the support frame 15 in the right and left direction, there is fixedly welded a center connecting bracket 20 for pivotably connecting an engaging pin 19 as one example of a connected member for pivoting the pivot arm 11 and the bucket 12. A leading end of the pivot arm 11 is inserted and pivotably connected thereat by a pin 21 between a pair of plate members 20*a* and 20*a* projecting rearwardly of the center connecting bracket 20. The engaging pin 19 is pivotably engaged at a stopper hook portion 22 formed at a forward portion of the bracket 20.

On the front side of the vertical plate frames 17, 17 of the side connecting brackets 14, 14, there are formed connecting portions 24 and 24 recessed in between the connected members 13 and 13 while overlapping each other as viewed sidewise and to be inserted therethrough by the connecting pins 23 and 23. The connecting pins 23 and 23 are separatively connected to each other via a link mechanism 26, such that with a pivotal operation of the single operational lever 25, the connecting pins 23 and 23 slide simultaneously in the opposite directions to selectively provide a pivotably-connected condition and a disconnected condition between the adapter A and the bucket 12. For permiting a visual confirmation of the completion of connection of the connecting pins 23, 23, the outer side plate members 16 and 16 of the side connecting brackets 14, 14 are so formed as to allow visual inspection of the connecting portions 24 and 24 from the outside of the vehicle.

Figure 4:
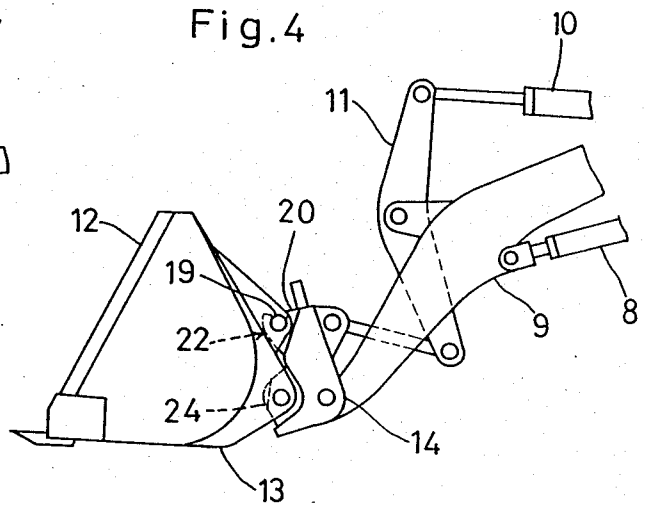
FIG. 4 is a side view of the major portions as connected with the work implement.
Figure 3:
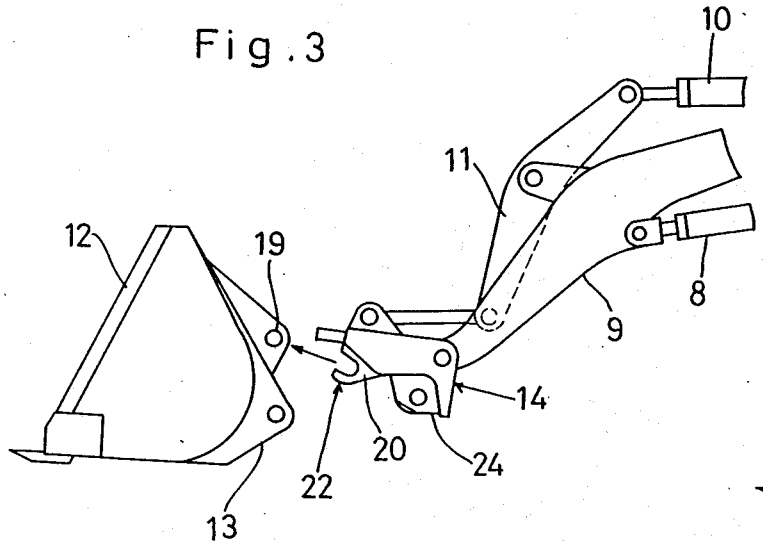
FIG. 3 is a side view of the major portions before connecting the work implement.

With the above-described construction, the connecting operation of the bucket 12 may be readily carried out. That is, for connecting the bucket 12, as illustrated in FIG. 3, with maintaining the center connecting bracket 20 positioned forwardly of the side connecting brackets 14 and 14, the vehicle body is driven forwardly to bring the engaging pin 19 of the bucket 12 into a hooked engagement with the stopper hook portion 22. Then, the driving arm 11 is driven rearwardly to insert the lifting right and left connecting portions 24 and 24 into the connected members 13 and 13; and in this condition, the operational lever 25 is operated to connect the pins 23 and 23, whereby the connecting operation is completed as illustrated in FIG. 4.

Figure 5:
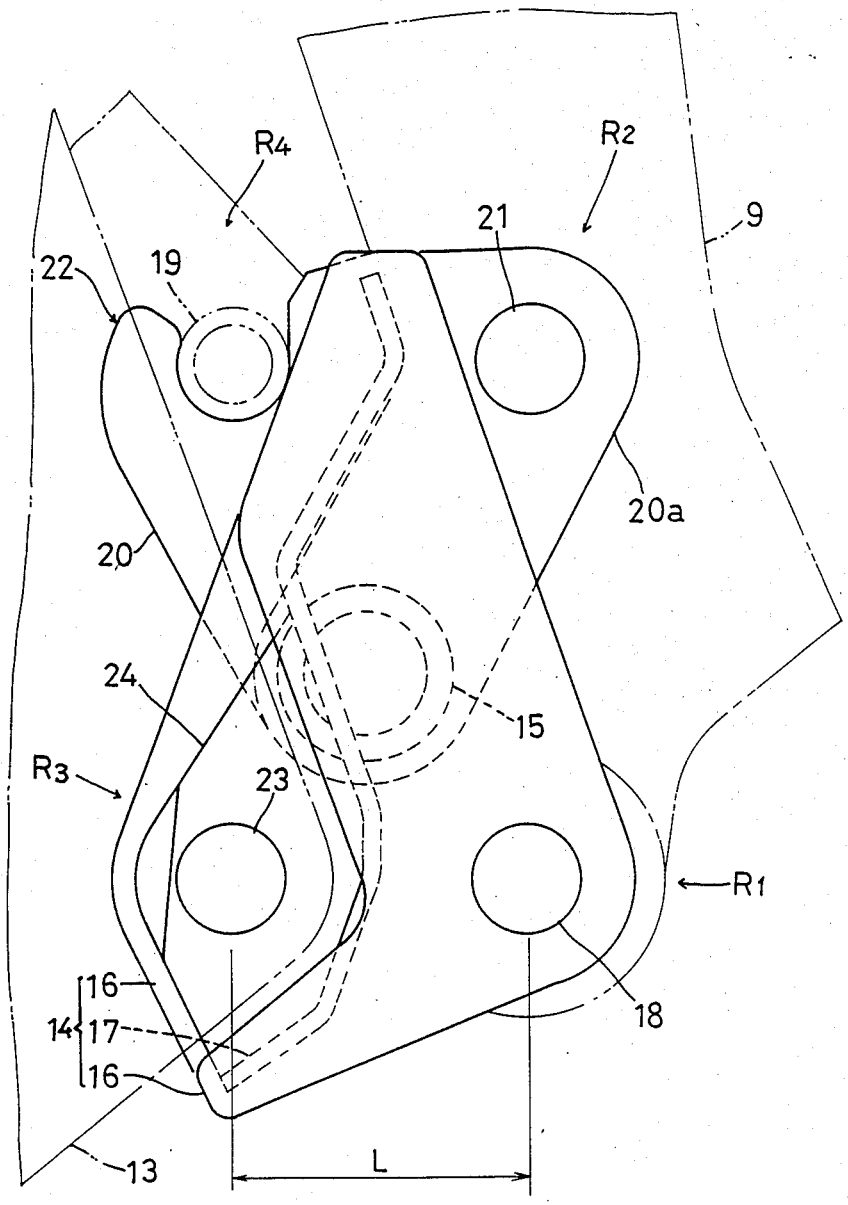
FIG. 5 is an enlarged side view of the major portions.

Next, as shown in FIG. 5, respective pivot connecting portions R1 and R2 for the lift arms 9. 9, the pivot arm 11 and the respective connecting brackets 14 and 20 are recessed forwardly relative to the rear end of the support frame 15 in the side view. Also, the pivot connecting portions R3 and R4 for the right and left connected members 13 and 13 of the bucket 12 and the respective connecting brackets 14 and 20 are recessed rearwardly relative to the front end of the support frame 15. Moreover, the pivot connecting portions R1, R3 and R2, R4 are positioned on the same altitudes, respectively.

Figure 7:
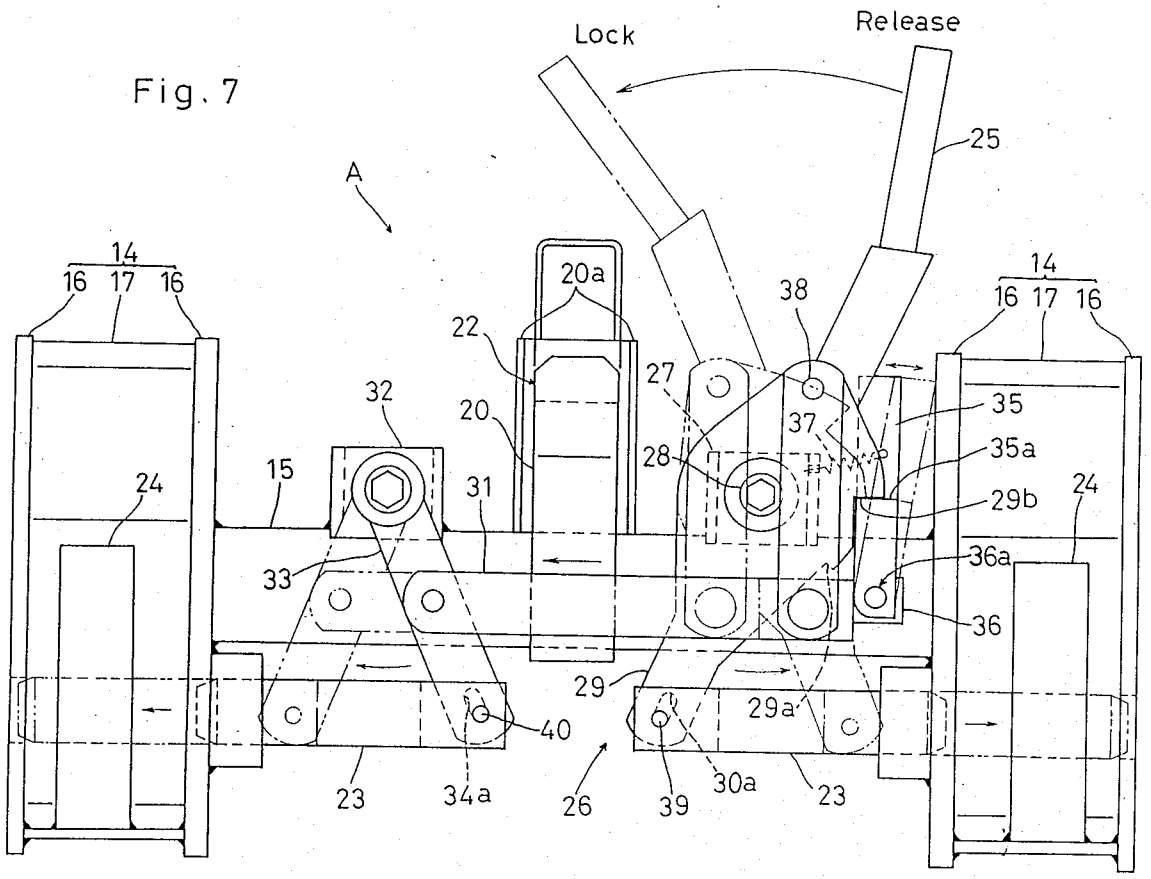
FIG. 7 is a front view of the adapter.
Figure 8:
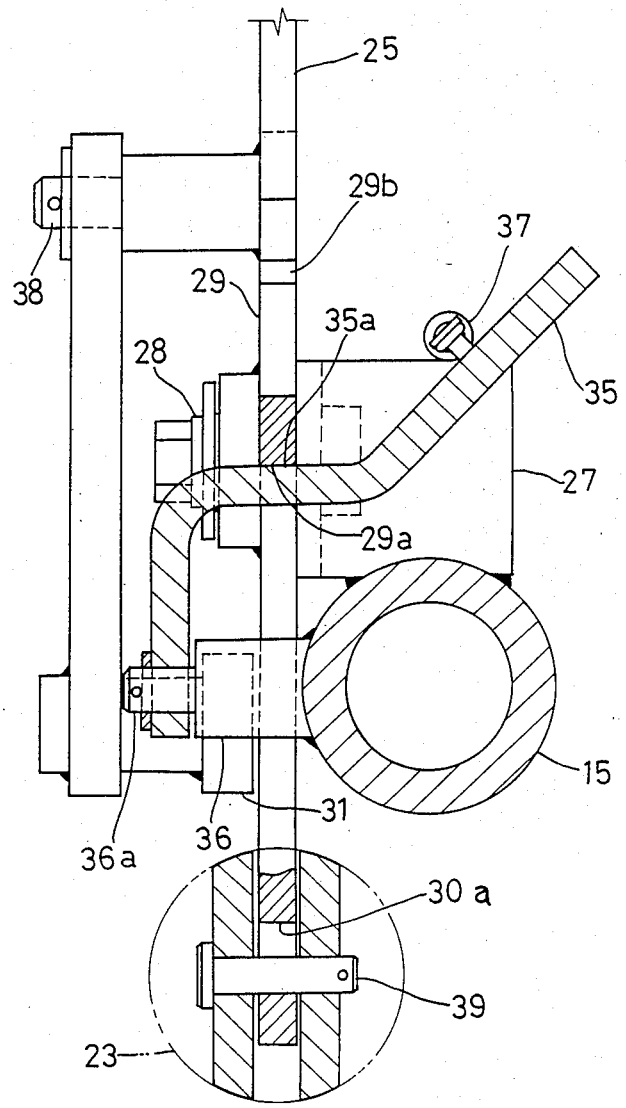
FIG. 8 is a vertical section view showing pivot arms of the adapter.

With this arrangement, compared with the case where the bucket 12 is directly connected to the respective arms 9, 9 and 11 without using the adapter A, it becomes possible to minimize a length L of the forward displacement of the bucket 12, i.e. the offset amount. Further, since the vertical position of the bucket 12 does not change, there occurs no significant variation in the driving and operating feels. Next, referring to FIGS. 6, 7 and 8, a pivot arm 28, which is oriented in the fore and aft direction, is fitted to a support member 27 having a hook shape in plane view and fixedly welded on the support frame 15. On the pivot shaft 28, there is pivotably mounted a pivot arm 29. This pivot arm 29 pivotably connects at one pivotal end thereof the left connecting pin 23 through a slot **30*a* and an engaging pin 39 projecting from an inner side face of the left connecting pin 23. Further, the other pivotal end of the pivot arm 29 is pivotably connected to the right connecting pin 23 via a link 31 having a letter 'L'-shaped configuration in the front view. That is, the link 31 is pivotably supported on the pin 38 continuously formed from the pivot arm 29. A lower pivotal end of a middle pivot link 33 pivotably supported by a support member 32 having a hook-shaped configuration in the plane view and welded to the support frame 15 is pivotably connected to the right connecting pin 23 via a slot 34*a* and an engaging pin 40. Further, an intermediate portion of the middle pivot link 33 and the right end of the 'L'-shaped link 31 are pivotably connected to each other. On the other hand, the operational lever 25 is integrally fixed to and operatively connected with the pivot arm 29**.

In operation, as the operational lever 25 is pivoted, the connecting pins 23 and 23 simultaneously slide towrds the outside to come into engagement with the connecting portions 24, 24 of the side connecting brackets 14 and 14 and also with the connected members 13, 13 of the bucket 12, thereby pivotably connecting between the adapter A and the bucket 12. Alternately, the connecting pins slide towards the inside to release the operative connection between the same.

Figure 6:
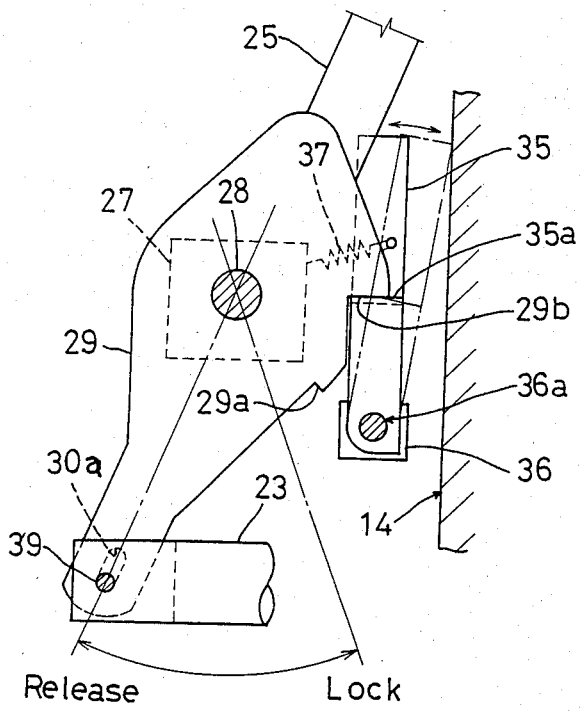
FIG. 6 is an enlarged front view of an operational arm.

Further, as shown also in FIG. 6, there is provided a pivot lock arm 35 for locking the pivot arm 29 at the operatively connected condition and for releasing the same from this condition. More particularly, on a front outer face of the support frame 15, there is welded a support member 36 acting as a pivot point element. And, the lock arm 35 is pivotably supported at a pivot support portion **36*a* of the support member 36. This lock arm 35 is integrally formed letter 'L'-shaped in the side view with its pivotal end being bent upwards. On the other hand, at an intermediate position of the side face of the pivot arm 29, there is defined a first stepped portion 29*a*, whereby in the operatively connected condition this first stepped portion 29*a* of the pivot arm 29 comes into engagement with a horizontal portion 35*a* acting as a lock engaging portion of the pivot lock arm 35 and locked thereat. For releasing the lock arm 35, its pivotal end is manually swung to the left to come out of the engagement with the first stepped portion 29*a*. Further, the lock arm 35 is urged towards the locking direction by means of a spring 37 disposed between the arm 35 and the support member 27, whereby the lock arm 35** may reliably provide the locking effect.

Upwardly of the first stepped portion **29*a* of the pivot arm 29, there is formed a second stepped portion 29*b* acting as a contact engaging portion. As this second stepped portion 29*b* comes into fixed engagement with the horizontal portion 35*a* of the pivot lock arm 35, it becomes possible, in the connection-released condition, to limit movement of the pivot arm 29, i.e. the connecting pins 23, 23** exceeding the connection-released condition.

In this way, while inadvertent disengagement of the connecting pins 23, 23 is reliably prevented, the operational lever 25 may be operated directly when the operative connection is needed, whereby the operability has been improved. Moreover, since the regulations of the two positions are effected only through the engagement between the lock arm 35 and the pivot arm 29, the positioning operations may be effected with higher precision.

Figure 9:
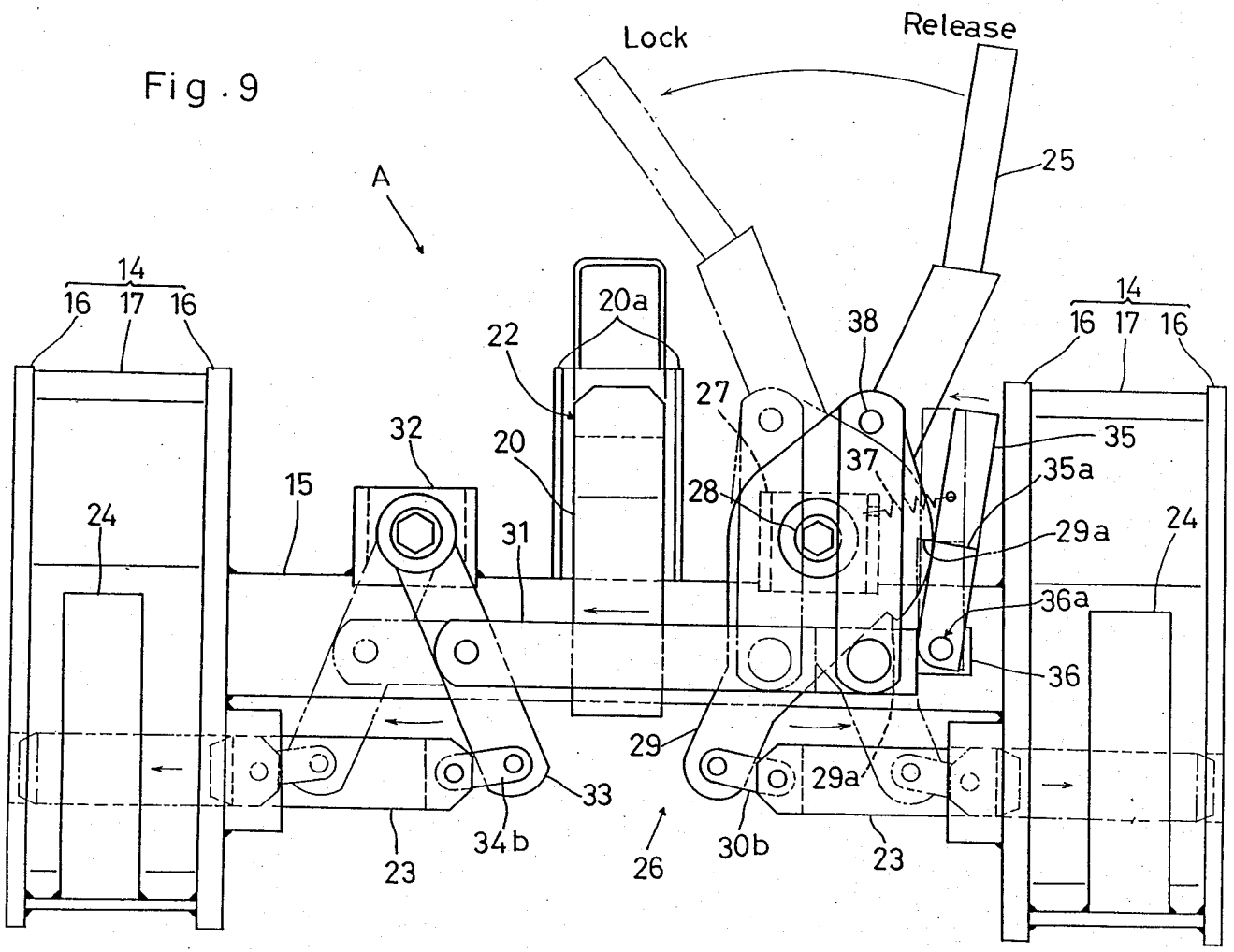
FIG. 9 is a front view of an adapter having a pivot arm mechanism related to an alternate embodiment of the invention.
Figure 10:
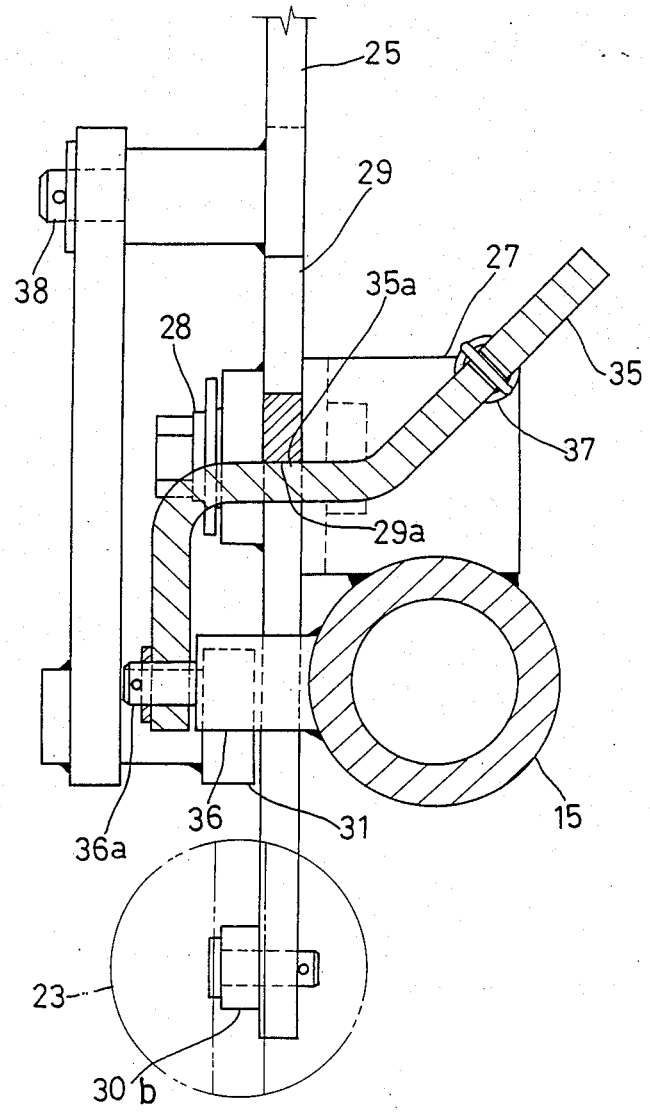
FIG. 10 is a vertical section of the construction shown in FIG. 9.
Figure 11:
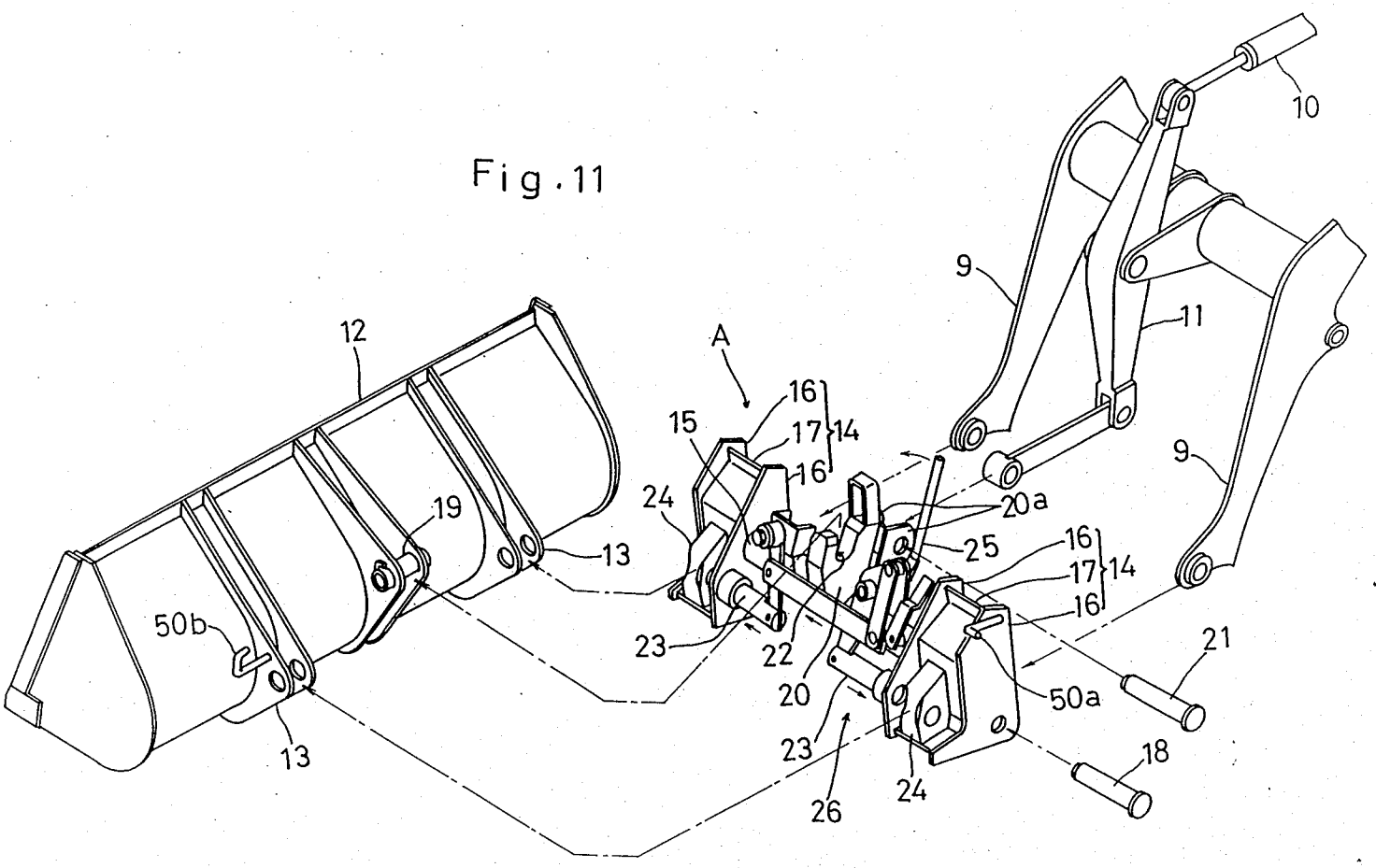
FIG. 11 is an exploded perspective view of major portions including position guide members related to a further embodiment of the invention.
Figure 13:
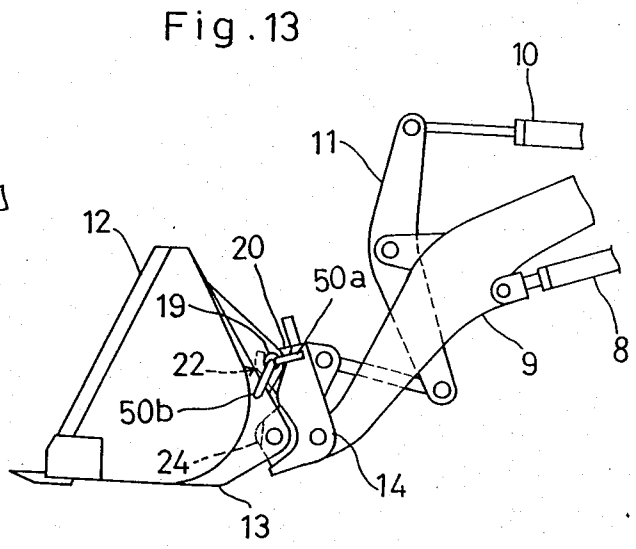
FIG. 13 is a side view of the major portions as connected with the work implement of the embodiment of FIG. 11.

FIGS. 9 and 10 illustrate an alternate embodiment of the above construction. In this embodiment construction, one pivotal end of the pivot arm 29 is pivotably connected with the left connecting pin 23 through an auxiliary link **30*b*, and the other pivotal end of the arm 29 is pivotably connected with the right connecting pin 23 through a link 31 having a letter 'L'-shaped configuration in the front view. More particularly, the link 31 is pivotably supported on a pin 38 extending continuously from the pivot arm 29. The lower pivotal end of the middle pivot link 33 pivotably supported by the support member 32 having a hook-shaped configuration in the plane view and welded to the support frame 15 is pivotably connected to the right connecting pin 23 via an auxiliary link 34*b*. Further, the intermediate portion of the middle pivot link 33 and the right end of the 'L'-shaped link 31 are pivotably connected to each other. On the other hand, the operational lever 25 is integrally fixed to and operatively connected with the pivot arm 29**.

In operation, if the operational lever 25 is operated for the releasing action, the 'L'-shaped link 31 comes into contact with the support member 36, thereby limiting further movement of the lever 25 towards the releasing direction. In this released condition, the pivot arm 29 has its position maintained by the contact urging force applied by the spring-urged lock arm 35.

With the above construction, the locking mechanism for locking the connected condition acts also as a movement limiting member for limiting the movement of the arm towards the releasing direction, whereby the construction has been simplified.

Next, a positioning mechanism for the adapter and the work implement will be described with reference to FIGS. 11 through 15. As shown, the left side connecting bracket 14 and the left lifting connected member 13 respectively include at a left side portion thereof target guide members **50*a* and 50*b* for aligning the fore and aft positions of the adapter A and the bucket 12. These guide members 50*a* and 50*b*, as illustrated in FIG. 15, have respective leading ends thereof opposed in parallel with each other in the right and left direction when the fore and aft positions of the stopper hook portion 22 and the engaging pin 19** are aligned to each other.

Figure 12:
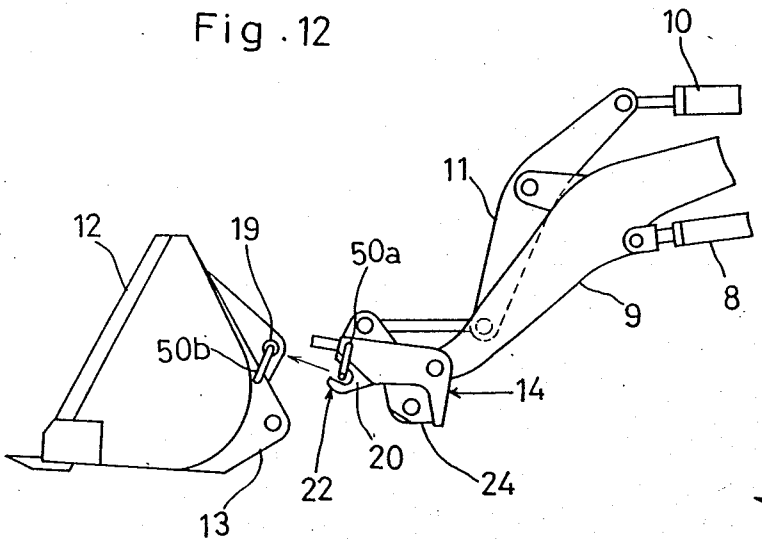
FIG. 12 is a side view of the major portions before connection of the work implement of the embodiment of FIG. 11.
Figure 14:
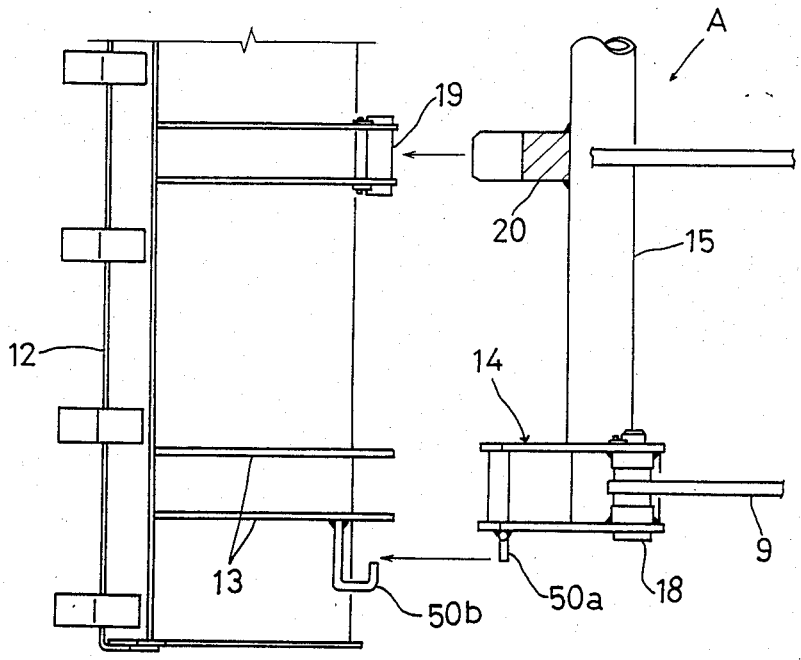
FIG. 14 is a plane view of the major portions before connection of the work implement of the embodiment of FIG. 11.
Figure 15:
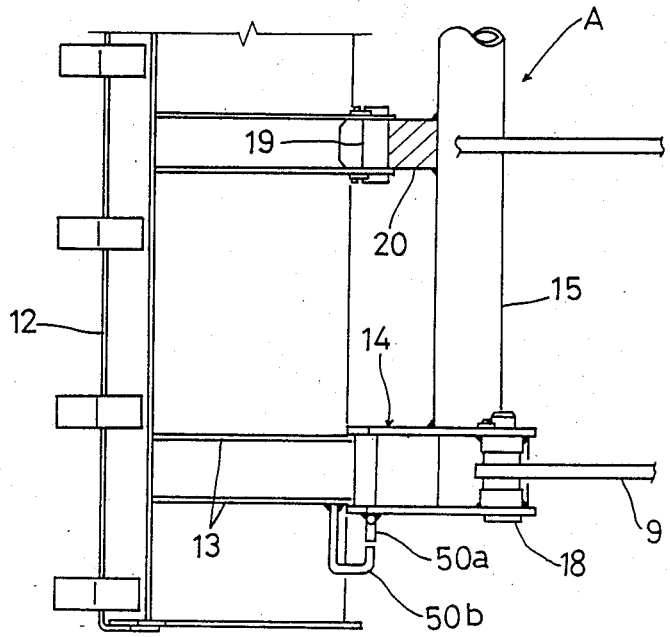
FIG. 15 is a plane view of the major portions as connected with the work implement of the embodiment of FIG. 11.

With the above-described target guide members **50*a* and 50*b***, the positioning operations with a forward travelling of the vehicle body as illustrated in FIGS. 12 and 14 may be carried out very easily.

Figure 16:
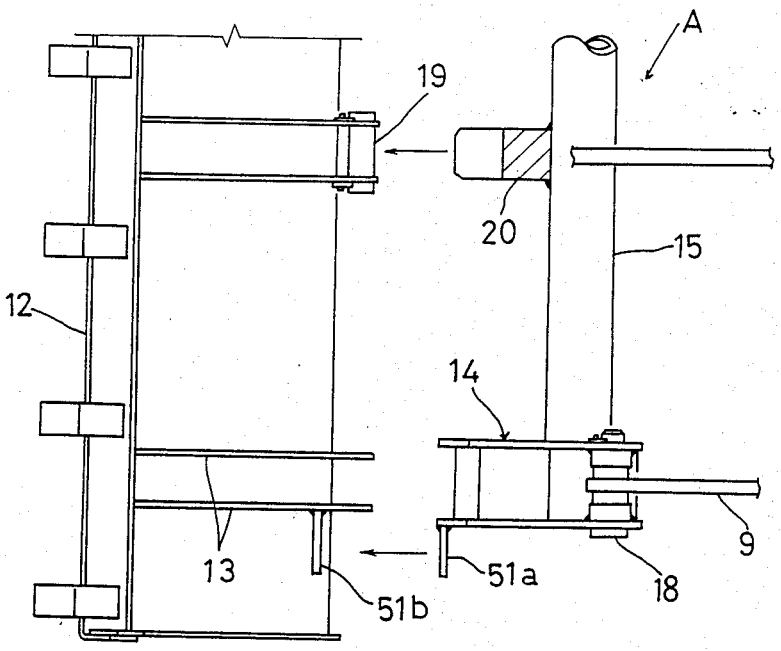
FIG. 16 is a plane view of major portions of an adapter related to a still further embodiment including different type of position guide members, with the adapter being not connected with the work implement.
Figure 17:
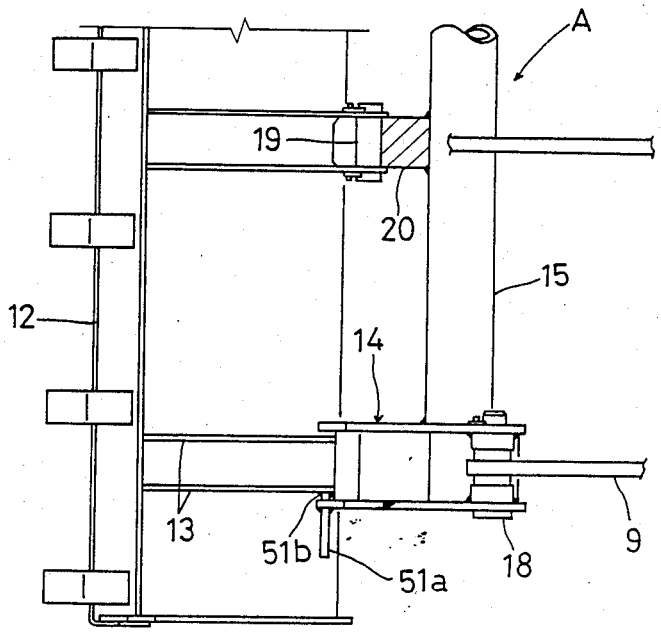
FIG. 17 is a plane view of the major portions of the adapter of FIG. 16 as connected with the work implement.

Alternately, as shown in FIGS. 16 and 17, the guide members 50*a* and 50*b* may be formed of horizontally oriented bar members, such that in the positon aligned condition the guide members are positioned adjacent each other in the fore and aft direction and overlapped each other as viewed from the driver of the vehicle.

Also conceivably, the guide members 50*a* and 50*b* may be disposed either at the right or left side of the vehicle body.

Incidentally, although reference marks and numerals are provided in the appended claims of the patent application for the purpose of facilitating reference to the accompanying drawings, it is to be understood that these are not to limit the scope of the invention to those constructions illustrated in the drawings.

What is claimed is:

1. In a work-implement connecting adapter for a front loader connecting at a front portion thereof a front-mount work implement (12) and connecting at rear portions thereof a pair of work-implement lift arms (9, 9) extending from a vehicle body and a work-implement pivot arm (11) disposed at a middle therebetween, the adapter, comprising:

a pair of right and left side brackets (14, 14), each bracket including a pair of plate members (16, 16) rigidly interconnected via a vertical plate frame (17) extending laterally relative to the vehicle body, said side brackets (14, 14) pivotably connecting said pair of work-implement lift arms (9, 9) and a pair of lifting connecting members (13, 13) fixed to the work implement;

a support frame (15) for fixedly connecting between the inner pair of said plate members (16, 16) of the side brackets (14, 14);

connecting portions (24, 24) formed on the vertical plates of the side brackets to fit between sides of said lifting connected members (13, 13), and connecting pins (23, 23) slidable in a horizontal plane for securing said lifting connected members to said right and left side brackets, and a center connecting bracket (20) disposed at an intermediate portion of said support frame (15) and having at a front portion thereof an engaging hook portion (22) for pivotably connecting a pivoting connected member (19) of the work implement and pivotably connecting said work-implement pivot arm (11) at a rear portion thereof.

2. In a work-implement connecting adapter for a front loader connecting at a front portion thereof a front-mount work implement (12) and connecting at rear portions thereof a pair of work-implement lift arms (9, 9) extending from a vehicle body and a work-implement pivot arm (11) disposed at a middle therebetween, the adapter, comprising:

a pair of right and left side brackets (14, 14), each side bracket including a pair of plate members (16, 16) rigidly interconnected via a vertical plate frame (17) extending laterally relative to the vehicle body, said side brackets (14, 14) pivotably connecting said pair of work-implement lift arms (9, 9) and a pair of lifting connected members (13, 13) fixed to the work implement;

a support frame (15) for fixedly connecting between the inner pair of said plate members (16, 16) of the side brackets (14, 14); and a center connecting bracket (20) disposed at an intermediate portion of said support frame (15) and having at a front portion thereof an engaging hook portion (22) for pivotably connecting a pivoting connected member (19) of the work implement and pivotably connecting said work-implement pivot arm (11) at a rear portion thereof, a link mechanism for pivotably and detachably connecting the front-mount work implement (12) by means of a right and left pair of connecting pins (23, 23), with said one connecting pin (23) being pivotably connected to one pivotal end of a pivot arm (29) pivotably supported to said support frame (15) whereas said other connecting pin (23) being pivotably connected to the other pivotal end of said pivot arm (29 via a link (31), wherein a pivotably connected condition is realized if said connecting pins (23, 23) slide simultaneously towards the outside to come into engagement with the work implement (12) while alternately a connection-released condition is realized if said connecting pins (23, 23) slide simultaneously towards the inside to come out of said engagement.

3. An adapter as defined in claim 2, wherein on the front side of said vertical plate frames (17, 17) of the side connecting brackets (14, 14), there are formed connecting portions (24, 24) recessed in between said lifting connected members (13, 13) while overlapping each other as viewed sidewise and to be inserted therethrough by said connecting pins (23, 23).

4. An adapter as defined in claim 2, wherein a switching operation between said pivotably connected condition and said connection-released condition is effected by an operation of an operational lever (25) operatively connected to said pivot arm (29).

5. An adapter as defined in claim 2, further comprising:

a pivot lock arm (35) for locking said pivot arm (29) at the engaged position and for releasing the same therefrom, the locked condition being realized as a first stepped portion (29*a*) of said pivot arm (29) comes into engagement with a lock engaging portion (35*a*) of said pivot lock arm (35).

6. An adapter as defined in claim 5, wherein said pivot lock arm (35) includes an urging element for constantly urging said pivot lock arm (35) towards its engagement with said pivot arm (29).

7. An adapter as defined in claim 6, wherein said urging element is a spring (37).

8. An adapter as defined in claim 2, wherein the pivotable connections between said pivot arm (29) and the link (31) with the pair of said connecting pins (23, 23) are effected through slots (30*a*, 34*a*) and engaging pins (40) provided respectively thereto.

9. An adapter as defined in claim 2, wherein the pivotable connections between said pivot arm (29) and the link (31) with the pair of said connecting pins (23, 23) are effected through middle pivot links (30*b*, 34*b*) provided therebetween.

10. An adapter as defined in claim 6, wherein said pivot arm (29) further includes a second stepped portion (29*b*) which comes into abutment with said lock engaging portion (35*a*) thereby limiting movement of said pivot arm (29) towards the releasing side exceeding the released position thereof.

11. An adapter as defined in claim 6, wherein in said released condition said link (31) comes into contact with a pivot (36) of said pivot lock arm (35) thereby limiting movement of said pivot arm (29) towards the releasing side exceeding the released position thereof.

12. An adapter as defined in claim 2, wherein respective pivot connecting portions (R1 and R2) for said lift arms (9, 9), said pivot arm (11) and said respective connecting brackets (14 and 20) are recessed forwardly relative to the rear end of said support frame (15) in the side view, and pivot connecting portions (R3 and R4) for said right and left connected members (13, 13) of said work implement (12) and said respective connecting brackets (14 and 20) are recessed rearwardly relative to the front end of said support frame 15.

13. In a work-implement connecting adapter (A) for a front loader connecting at a front portion thereof a front-mount work implement (12) and connecting at rear portions thereof a pair of work-implement lift arms (9, 9) extending from a vehicle body and a work-implement pivot arm (11) disposed at a middle therebetween, the adapter, comprising:

a pair of right and left side brackets (14, 14), each side bracket including a pair of plate members (16, 16) rigidly interconnected via a vertical plate frame (17) extending laterally relative to the vehicle body, said side brackets (14, 14) pivotably connecting said pair of work-implement lift arms (9, 9) and a pair of lifting connected members (13, 13) fixed to the work implement;

one of said side connecting brackets (14) and said lifting connected members (13) respectively include at a lateral side thereof target guide members (50*a* and 50*b*) for aligning the positions of said adapter (A) and said work implement (12), with said target guide members (50*a* and 50*b*), at said aligned condition, having respective leading ends thereof opposed in parallel with each other in the right and left direction, a support frame (15) for fixedly connecting between the inner pair of said plate members (16, 16) of the side brackets (14, 14); and a center connecting bracket (20) disposed at an intermediate portion of said support frame (15) and having at a front portion thereof an engaging hook portion (22) for pivotably connecting a pivoting connected member (19) of the work implement and pivotably connecting said work-implement pivot arm (11) at a rear portion thereof.

14. In a work-implement connecting adapter for a front loader connecting at a front portion thereof a front-mount work implement (12) and connecting at rear portions thereof a pair of work-implement lift arms (9, 9) extending from a vehicle body and a work-implement pivot arm (11) disposed at a middle therebetween, the adapter, comprising:

a pair of right and left side brackets (14, 14), each side bracket including a pair of plate members (16, 16) rigidly interconnected via a vertical plate frame (17) extending laterally relative to the vehicle body, said side brackets (14, 14) pivotably connecting said pair of work-implement lift arms (9, 9) and a pair of lifting connected members (13, 13) fixed to the work implement;

one of said side connecting brackets (14) and said lifting connected members (13) respectively include at a lateral side thereof target guide members (50*a* and 50*b*) for aligning the positions of said adapter (A) and said work implement (12), with said target guide members (50*a* and 50*b*), at said aligned condition, being positioned adjacent each other in the fore and aft direction and overlapped each other as viewed by a driver of the vehicle, a support frame (15) for fixedly connecting between the inner pair of plate members (16, 16) of the side brackets (14, 14); and a center connecting bracket (20) disposed at an intermediate portion of said support frame (15) and having at a front portion thereof an engaging hook portion (22) for pivotably connecting a pivoting connected member (19) of the work implement and pivotably connecting said work-implement pivot arm (11) at a rear portion thereof.

* * * * *